US012152814B2

(12) United States Patent
Kimura et al.

(10) Patent No.: US 12,152,814 B2
(45) Date of Patent: Nov. 26, 2024

(54) HEAT EXCHANGER AND AIR-CONDITIONING APPARATUS INCLUDING THE HEAT EXCHANGER

(71) Applicant: Mitsubishi Electric Corporation, Tokyo (JP)

(72) Inventors: Takanao Kimura, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 206 days.

(21) Appl. No.: 17/912,925

(22) PCT Filed: May 22, 2020

(86) PCT No.: PCT/JP2020/020345
§ 371 (c)(1),
(2) Date: Sep. 20, 2022

(87) PCT Pub. No.: WO2021/234952
PCT Pub. Date: Nov. 25, 2021

(65) Prior Publication Data

US 2023/0148118 A1 May 11, 2023

(51) Int. Cl.
*F25B 30/02* (2006.01)
*F25B 6/04* (2006.01)
*F25B 41/20* (2021.01)

(52) U.S. Cl.
CPC ..... *F25B 30/02* (2013.01); *F25B 6/04* (2013.01); *F25B 41/20* (2021.01)

(58) Field of Classification Search
CPC ..... F28D 1/05383; F28F 27/02
See application file for complete search history.

(56) References Cited

U.S. PATENT DOCUMENTS 5,101,640 A 4/1992 Fukushima et al.
5,529,116 A * 6/1996 Sasaki ..... F28D 1/0435 165/145

(Continued)

FOREIGN PATENT DOCUMENTS

JP 2875309 B2 3/1999
WO 2015/005352 A1 1/2015

OTHER PUBLICATIONS

International Search Report of the International Searching Authority mailed Aug. 11, 2020 in corresponding International Patent Application No. PCT/JP2020/020345 (with English translation).

(Continued)

*Primary Examiner* — Ana M Vazquez
(74) *Attorney, Agent, or Firm* — Posz Law Group, PLC

(57) ABSTRACT

A heat exchanger includes a plurality of heat exchange units each including a plurality of flat tubes, a plurality of fins, an upper header, and a lower header. In the plurality of heat exchange units, the upper headers are connected such that the upper headers communicate with each other, and the lower headers are connected such that the lower headers communicate with each other through an opening-closing valve. The heat exchanger has a configuration in which when the heat exchanger serves as a condenser, the opening-closing valve is controlled such that refrigerant in at least one of the plurality of heat exchange units flows in an upward direction, and refrigerant in the other one or the other ones of the plurality of heat exchange units flows in a downward direction.

5 Claims, 5 Drawing Sheets

(56) References Cited

U.S. PATENT DOCUMENTS

| | | | | |
|---|---|---|---|---|
| 2007/0131393 | A1* | 6/2007 | Sasaki | F28F 1/022 165/110 |
| 2016/0298886 | A1 | 10/2016 | Ishibashi et al. | |

OTHER PUBLICATIONS

Office Action dated Aug. 29, 2023 issued in corresponding Japanese Patent Application No. 2022-524840 (and English translation).
Examination Report dated Nov. 10, 2023 issued in corresponding GB Patent Application No. 2216005.5.

* cited by examiner

HEAT EXCHANGER AND AIR-CONDITIONING APPARATUS INCLUDING THE HEAT EXCHANGER

CROSS-REFERENCE TO RELATED APPLICATION

This application is a U.S. National Stage Application of International Application No. PCT/JP2020/020345 filed on May 22, 2020, the contents of which are incorporated herein by reference.

TECHNICAL FIELD

The present disclosure relates to a heat exchanger including a plurality of flat tubes, and fins provided between the flat tubes adjacent to each other, and also relates to an air-conditioning apparatus including the heat exchanger.

BACKGROUND

As disclosed in Patent Literature 1, some heat exchanger used in an outdoor unit of an air-conditioning apparatus has been known that includes a plurality of flat tubes spaced from and parallel to each other, a plurality of fins provided between the flat tubes adjacent to each other, an upper header, and a lower header. Inside each of the flat tubes, refrigerant flow passages are formed through which refrigerant flows in an up-down direction. Respective upper end portions of the plurality of flat tubes are connected to the upper header. Respective lower end portion of the plurality of flat tubes are connected to the lower header.

PATENT LITERATURE

Patent Literature 1: International Publication No. WO 2015/005352

The heat exchanger having the above configuration allows refrigerant to flow vertically upward inside the flat tubes. Thus, the refrigerant flow velocity needs to be increased. For example, a variable-capacity air-conditioning apparatus may sometimes perform part-load operation with a reduced operational frequency of a compressor when the air-conditioning load is low. In this case, in the heat exchanger disclosed in Patent Literature 1, refrigerant in all the flat tubes is equally affected by gravity. This may generate an area with a lower refrigerant flow velocity than the required refrigerant flow velocity for refrigerant to flow upward inside the flat tubes. There is thus a risk that heat exchange performance may be degraded.

SUMMARY

The present disclosure has been achieved to solve the above problem, and it is an object of the present disclosure to provide a heat exchanger and an air-conditioning apparatus including the heat exchanger, in which even when the air-conditioning apparatus performs part-load operation with a reduced operational frequency of a compressor, the heat exchanger still obtains a refrigerant flow velocity required for refrigerant to flow upward inside flat tubes, and still reduces degradation in heat exchange performance.

A heat exchanger according to one embodiment of the present disclosure is a heat exchanger including a plurality of heat exchange units configured to exchange heat between refrigerant and air. Each of the plurality of heat exchange units includes a plurality of flat tubes spaced from and parallel to each other and in which a refrigerant flow passage is formed through which refrigerant flows in an up-down direction, a plurality of fins provided between the plurality of flat tubes adjacent to each other, an upper header to which respective upper end portions of the plurality of flat tubes are connected, and a lower header to which respective lower end portions of the plurality of flat tubes are connected. In the plurality of heat exchange units, the upper headers are connected such that the upper headers communicate with each other, and the lower headers are connected such that the lower headers communicate with each other through an opening-closing valve. The heat exchanger has a configuration in which when the heat exchanger serves as a condenser, the opening-closing valve is controlled such that refrigerant in at least one of the plurality of heat exchange units flows in an upward direction, and refrigerant in the other one or the other ones of the plurality of heat exchange units flows in a downward direction.

An air-conditioning apparatus according to another embodiment of the present disclosure includes a compressor and the above heat exchanger through which refrigerant discharged from the compressor flows, and the opening-closing valve is controlled in response to an operational frequency of the compressor set in advance.

In the heat exchanger according to an embodiment of the present disclosure, and the air-conditioning apparatus including this heat exchanger, when, for example, the air-conditioning apparatus performs part-load operation with a reduced operational frequency of the compressor, the heat exchanger allows only refrigerant in some of the heat exchange units to flow upward inside the flat tubes, a refrigerant flow velocity required for refrigerant to flow upward inside the flat tubes is thus obtained, and consequently degradation in the heat exchange performance is reduced.

DETAILED DESCRIPTION

Embodiments of the present disclosure are described hereinafter with reference to the drawings. Note that in each of the drawings, the same or equivalent components are denoted by the same reference signs, and their descriptions are appropriately omitted or simplified. The shape, size, location, and other properties of the components described in each of the drawings may be appropriately changed.

Embodiment 1

Figure 1:
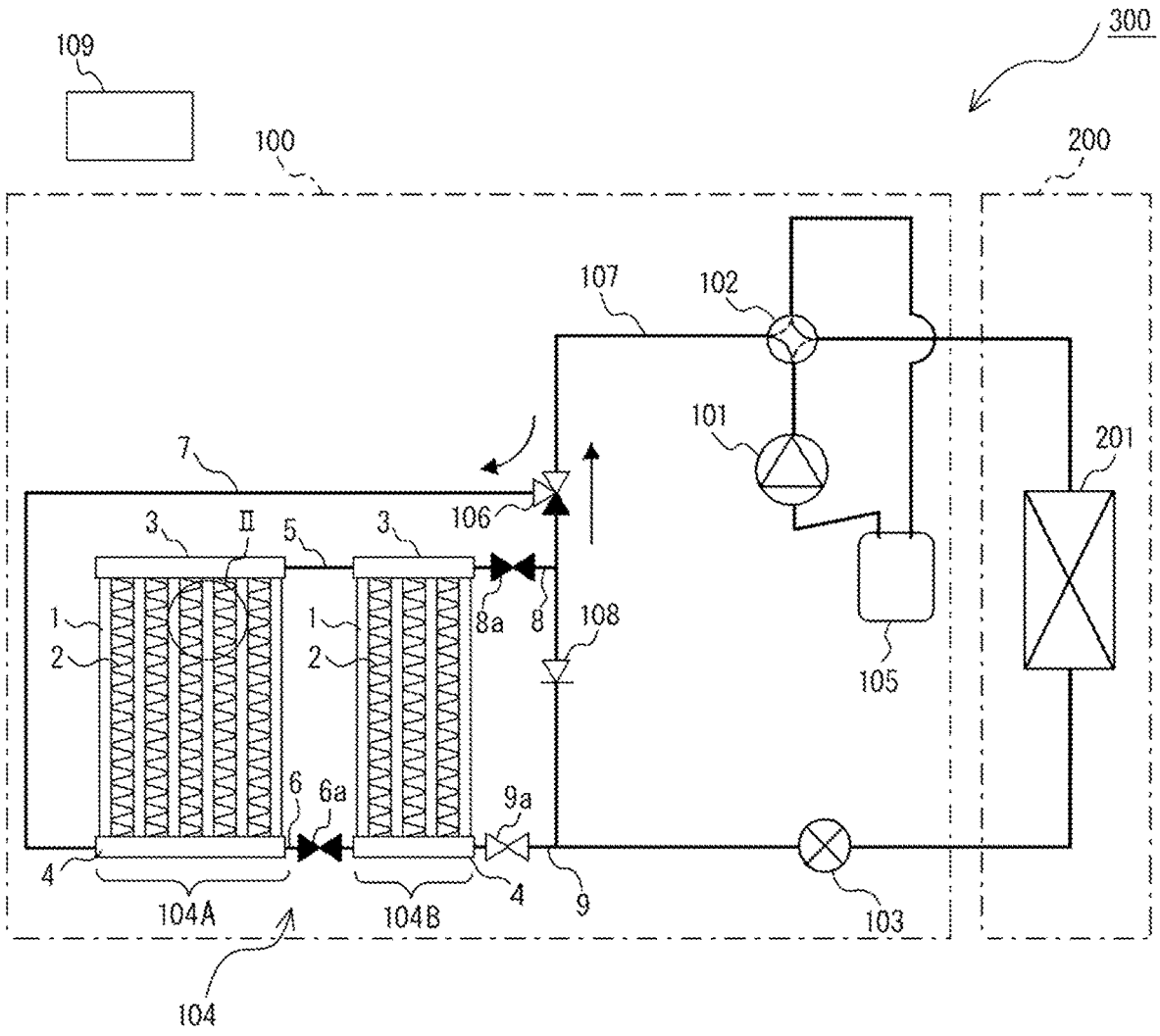
FIG. 1 is a refrigerant circuit diagram of an air-conditioning apparatus according to the present Embodiment 1.
Figure 2:
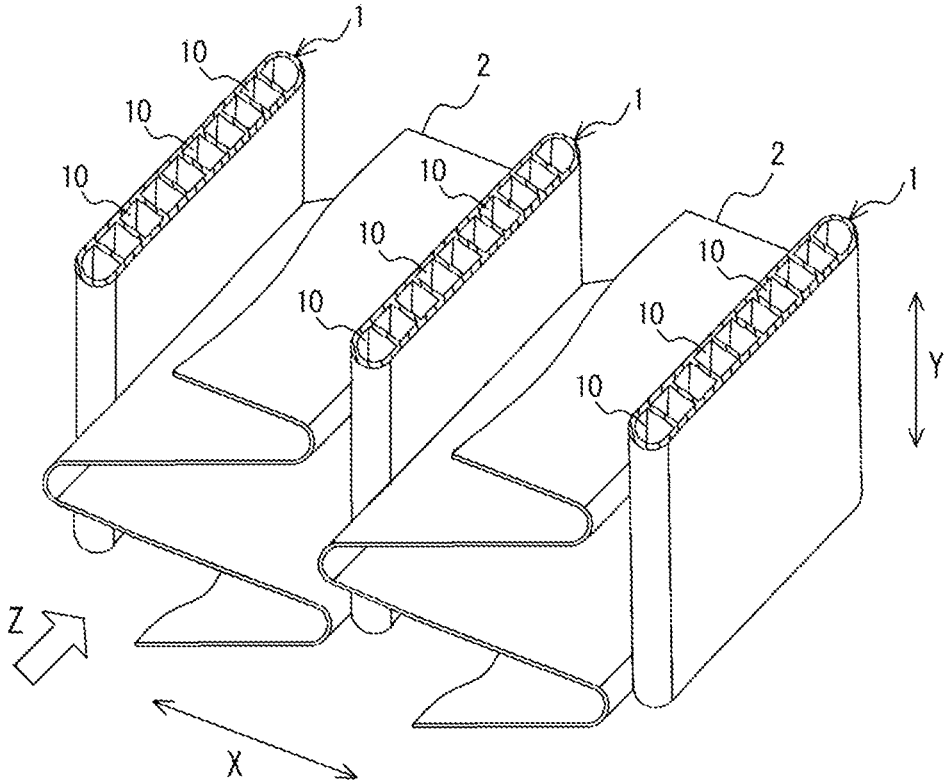
FIG. 2 is a perspective view of the cross-section of the portion II illustrated in FIG. 1 when the cross-section is viewed from above.

FIG. 1 is a refrigerant circuit diagram of an air-conditioning apparatus according to the present Embodiment 1. FIG. 2 is a perspective view of the cross-section of the portion II illustrated in FIG. 1 when the cross-section is viewed from above. Note that the arrows illustrated in FIG. 1 represent the flow direction of refrigerant. Every opening-closing valve in an opened state is represented by a white valve symbol. Every opening-closing valve in a closed state is represented by a black valve symbol.

As illustrated in FIG. 1, an air-conditioning apparatus 300 according to the present Embodiment 1 is made up of an outdoor unit 100 and an indoor unit 200. The air-conditioning apparatus 300 includes a refrigerant circuit in which a compressor 101, first flow switching means 102, an indoor heat exchanger 201, an expansion mechanism 103, an outdoor heat exchanger 104, and a refrigerant container 105 are connected by a refrigerant pipe 107 to allow refrigerant to circulate in the refrigerant circuit. The outdoor unit 100 includes the compressor 101, the first flow switching means 102, the expansion mechanism 103, the outdoor heat exchanger 104, and the refrigerant container 105. The indoor unit 200 includes the indoor heat exchanger 201. Note that the air-conditioning apparatus 300 is not limited to the one made up of the constituent elements illustrated in FIG. 1, but may include other constituent element.

Operation of the air-conditioning apparatus 300 is controlled by a controller 109. The controller 109 is made up of a computation device such as a microcomputer and a CPU, and software to be executed by the computation device. Note that the controller 109 may be made up of hardware such as a circuit device that implements the functions of the controller 109.

The compressor 101 compresses sucked refrigerant into a high-temperature and high-pressure state, and discharges the compressed refrigerant. The compressor 101 is, for example, a positive-displacement compressor configured to vary the operational capacity (frequency), and driven by a motor that is controlled by the inverter.

The first flow switching means 102 is, for example, a four-way valve, and is configured to switch the flow passages of refrigerant. During cooling operation, the first flow switching means 102 changes the refrigerant flow passage such that the refrigerant discharge port of the compressor 101 is connected to the gas portion of the outdoor heat exchanger 104, and the refrigerant suction port of the compressor 101 is connected to the gas portion of the indoor heat exchanger 201. In contrast, during heating operation, the first flow switching means 102 changes the refrigerant flow passage such that the refrigerant discharge port of the compressor 101 is connected to the gas portion of the indoor heat exchanger 201, and the refrigerant suction port of the compressor 101 is connected to the gas portion of the outdoor heat exchanger 104. Note that the first flow switching means 102 may be formed in combination with a two-way valve or a three-way valve.

The indoor heat exchanger 201 serves as an evaporator during cooling operation, and exchanges heat between air and refrigerant flowing out of the expansion mechanism 103. The indoor heat exchanger 201 serves as a condenser during heating operation, and exchanges heat between air and refrigerant discharged from the compressor 101. The indoor heat exchanger 201 sucks room air delivered by an indoor fan, and supplies the air having exchanged heat with refrigerant into the room.

The expansion mechanism 103 reduces the pressure of refrigerant flowing in the refrigerant circuit to expand the refrigerant. The expansion mechanism 103 is, for example, an electronic expansion valve whose opening degree is variably controlled. The refrigerant container 105 is, for example, a receiver or an accumulator. The refrigerant container 105 stores in its inside surplus liquid refrigerant during the operation.

The outdoor heat exchanger 104 serves as a condenser during cooling operation, and exchanges heat between air and refrigerant discharged from the compressor 101. The outdoor heat exchanger 104 serves as an evaporator during heating operation, and exchanges heat between air and refrigerant flowing out of the expansion mechanism 103. The outdoor heat exchanger 104 sucks outdoor air delivered by an outdoor fan, and discharges the air having exchanged heat with refrigerant to the outside.

The outdoor heat exchanger 104 according to the present Embodiment 1 includes a first heat exchange unit 104A and a second heat exchange unit 104B, each of which exchanges heat between refrigerant and air. As illustrated in FIGS. 1 and 2, each of the first heat exchange unit 104A and the second heat exchange unit 1048 includes a plurality of flat tubes 1 spaced from and parallel to each other and in which refrigerant flow passages 10 are formed through which refrigerant flows in an up-down direction Y, a plurality of fins 2 provided between the flat tubes 1 adjacent to each other, an upper header 3 to which respective upper end portions of the plurality of flat tubes 1 are connected, and a lower header 4 to which respective lower end portions of the plurality of flat tubes 1 are connected.

The flat tubes 1 are made of, for example, aluminum. The flat tubes 1 are spaced from each other in a left-right direction X, which is perpendicular to an airflow direction Z, and located parallel to each other. The flat tubes 1 are located with their flat faces extending substantially parallel to the airflow direction Z. Inside each of the flat tubes 1, a plurality of refrigerant flow passages 10, through which refrigerant flows in the up-down direction Y, are formed in line along the airflow direction Z. Note that the up-down direction Y not only refers to the vertical direction, but also includes a direction inclined to the vertical direction. In addition, the left-right direction X not only refers to the horizontal direction, but also includes a direction inclined to the horizontal direction.

The fins 2 are, for example, aluminum parts to transfer heat of refrigerant flowing inside the flat tubes 1. Each of the fins 2 is a corrugated fin formed by bending a thin plate into a wavy shape. The fin 2 is provided between two of the plurality of flat tubes 1 adjacent to each other. Each of the bent tip portions of the fin 2 is joined to the flat face of either of the two flat tubes 1. A space defined by the fin 2 and the flat tubes 1 serves as an air flow path. Note that the fin 2 may be provided with drain holes, louvers, or other portion, through which condensed water is drained, on the inclined surfaces of the fin 2, although the drain holes, louvers, and other portion are not illustrated. The fin 2 is not limited to a corrugated fin, and may be, for example, a plate fin.

As illustrated in FIG. 1, the first heat exchange unit 104A and the second heat exchange unit 1046 are located next to each other. One end of the upper header 3 of the first heat exchange unit 104A is connected to one end of the upper header 3 of the second heat exchange unit 1046 by a first connection pipe 5 such that these upper headers 3 communicate with each other. One end of the lower header 4 of the first heat exchange unit 104A is connected to one end of the lower header 4 of the second heat exchange unit 1046 by a second connection pipe 6 such that these lower headers 4 communicate with each other. The second connection pipe 6 is provided with an opening-closing valve 6*a*, which is controlled by the controller 109. The opening-closing valve 6*a* is, for example, a solenoid valve.

Note that instead of connecting the upper header 3 of the first heat exchange unit 104A to the upper header 3 of the second heat exchange unit 1046 by the first connection pipe 5, these upper headers 3 may be made up of a single upper header, although the single upper header is not illustrated. In addition, instead of connecting the lower header 4 of the first heat exchange unit 104A to the lower header 4 of the second heat exchange unit 1046 by the second connection pipe 6, these lower headers 4 may be made up of a single lower header. In this case, inside the single lower header, an opening-closing valve is provided to control communication between the first heat exchange unit 104A and the second heat exchange unit 1046.

The other end of the lower header 4 of the first heat exchange unit 104A is connected to a first flow pipe 7. The first flow pipe 7 branches off from a portion of the refrigerant pipe 107 connected between the first flow switching means 102 and the outdoor heat exchanger 104. The refrigerant pipe 107 is provided with second flow switching means 106 at a position where the first flow pipe 7 branches off from the refrigerant pipe 107. The second flow switching means 106 is, for example, a three-way valve and is controlled by the controller 109.

The other end of the upper header 3 of the second heat exchange unit 104B is connected through a second flow pipe 8 to a portion of the refrigerant pipe 107 connected between the second flow switching means 106 and the expansion mechanism 103. The second flow pipe 8 is provided with an opening-closing valve 8*a*, which is controlled by the controller 109. The opening-closing valve 8*a* is, for example, a solenoid valve.

The other end of the lower header 4 of the second heat exchange unit 104B is connected through a third flow pipe 9 to a portion of the refrigerant pipe 107 connected between the expansion mechanism 103 and the connection point with the second flow pipe 8. The third flow pipe 9 is provided with an opening-closing valve 9*a*, which is controlled by the controller 109. The opening-closing valve 9*a* is, for example, a solenoid valve.

A valve body 108 is provided in a portion of the refrigerant pipe 107 connected between the connection point with the second flow pipe 8 and the connection point with the third flow pipe 9. By use of the valve body 108, refrigerant flows only in one direction between the connection point with the second flow pipe 8 and the connection point with the third flow pipe 9.

Next, cooling operation of the air-conditioning apparatus 300 is described. High-temperature and high-pressure gas refrigerant discharged from the compressor 101 passes through the first flow switching means 102, and then flows through the first flow pipe 7 to the outdoor heat exchanger 104 to exchange heat with air and become liquid refrigerant. The liquid refrigerant flows out to the refrigerant pipe 107 through the second flow pipe 8 or the third flow pipe 9, and is reduced in the pressure by the expansion mechanism 103 into low-pressure two-phase gas-liquid refrigerant. The low-pressure two-phase gas-liquid refrigerant flows to the indoor heat exchanger 201 to exchange heat with air and become gas refrigerant. The gas refrigerant passes through the first flow switching means 102, and is sucked into the compressor 101 through the refrigerant container 105.

Next, heating operation of the air-conditioning apparatus 300 is described. High-temperature and high-pressure gas refrigerant discharged from the compressor 101 passes through the first flow switching means 102, and then flows to the indoor heat exchanger 201 to exchange heat with air and become liquid refrigerant. The liquid refrigerant is reduced in the pressure by the expansion mechanism 103 into low-pressure two-phase gas-liquid refrigerant. The low-pressure two-phase gas-liquid refrigerant flows through the third flow pipe 9 to the outdoor heat exchanger 104 to exchange heat with air and become gas refrigerant. The gas refrigerant flows out to the refrigerant pipe 107 through the second flow pipe 8, and then passes through the first flow switching means 102. Thereafter, the gas refrigerant is sucked into the compressor 101 through the refrigerant container 105.

Figure 3:
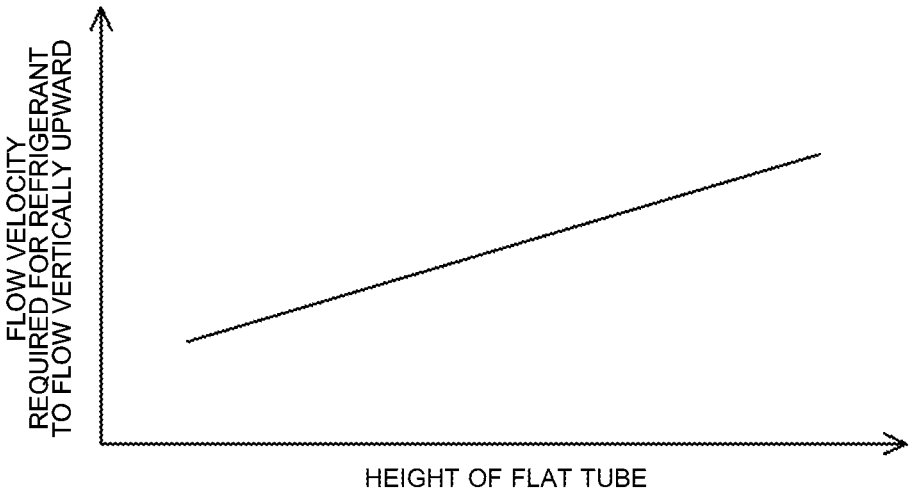
FIG. 3 is a graph that illustrates the relationship between the height of flat tube of a heat exchanger according to the present Embodiment 1 and the flow velocity required for refrigerant to flow vertically upward.

FIG. 3 is a graph that illustrates the relationship between the height of flat tube of the heat exchanger according to the present Embodiment 1 and the flow velocity required for refrigerant to flow vertically upward. The horizontal axis represents the height of flat tube. The vertical axis represents the refrigerant flow velocity required for refrigerant to flow vertically upward.

The above outdoor heat exchanger 104 allows refrigerant to flow vertically upward inside the flat tubes 1. Thus, as illustrated in FIG. 3, as the height of the flat tube 1 increases, the refrigerant flow velocity, required for refrigerant to flow vertically upward, increases. For example, a variable-capacity air-conditioning apparatus 300 may sometimes perform part-load operation with a reduced operational frequency of the compressor 101 when the air-conditioning load is low. In this case, in the outdoor heat exchanger 104, refrigerant in all the flat tubes 1 is equally affected by gravity. This may generate an area with a lower refrigerant flow velocity than the required refrigerant flow velocity for refrigerant to flow upward inside the flat tubes 1. There is thus a risk that heat exchange performance may be degraded.

Figure 4:
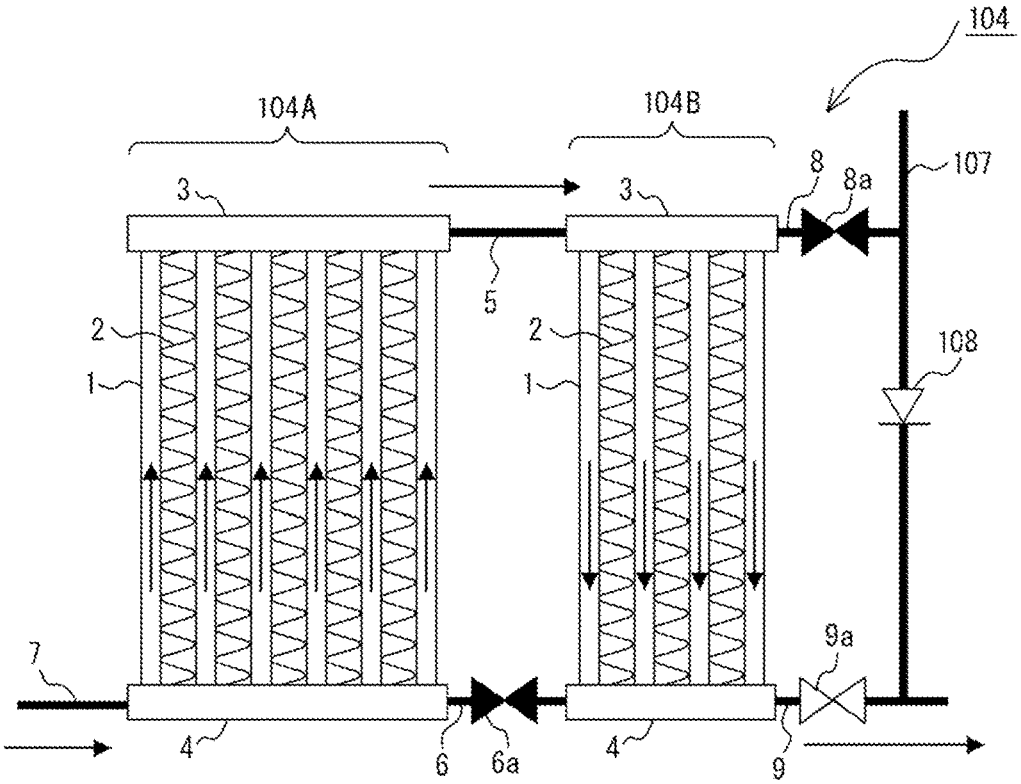
FIG. 4 is an explanatory diagram that illustrates operation of the heat exchanger according to the present Embodiment 1 when the air-conditioning load is low during cooling operation.
Figure 5:
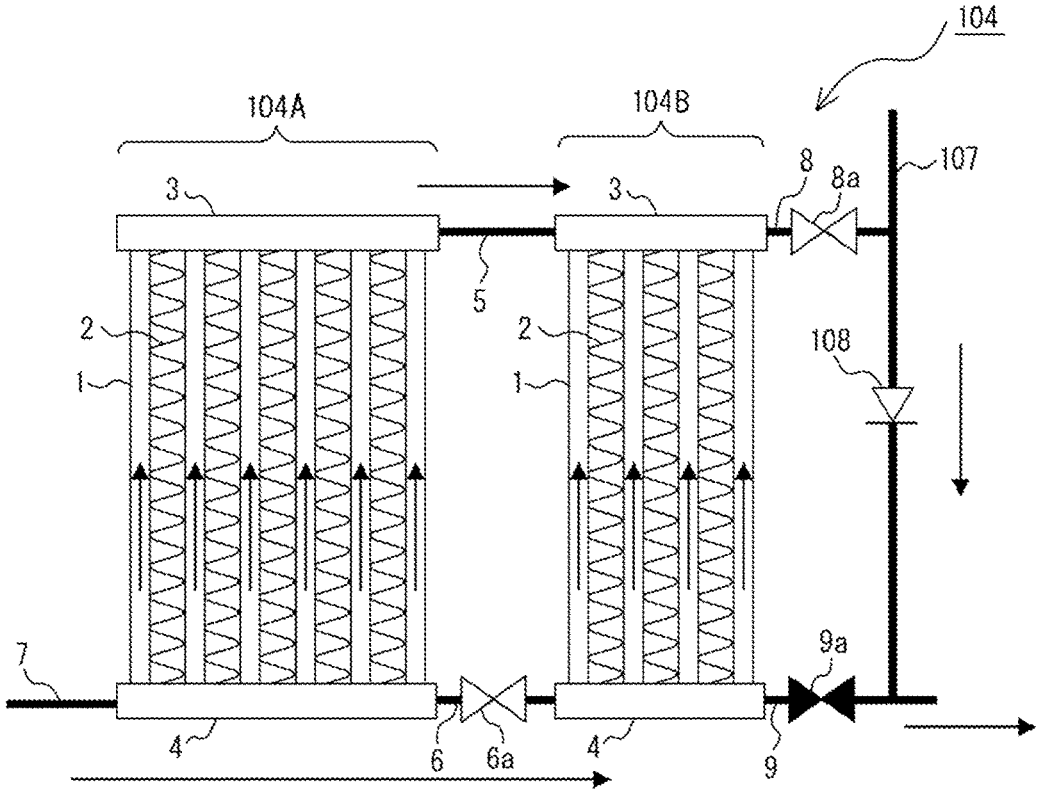
FIG. 5 is an explanatory diagram that illustrates operation of the heat exchanger according to the present Embodiment 1 when the air-conditioning load is high during cooling operation.
Figure 6:
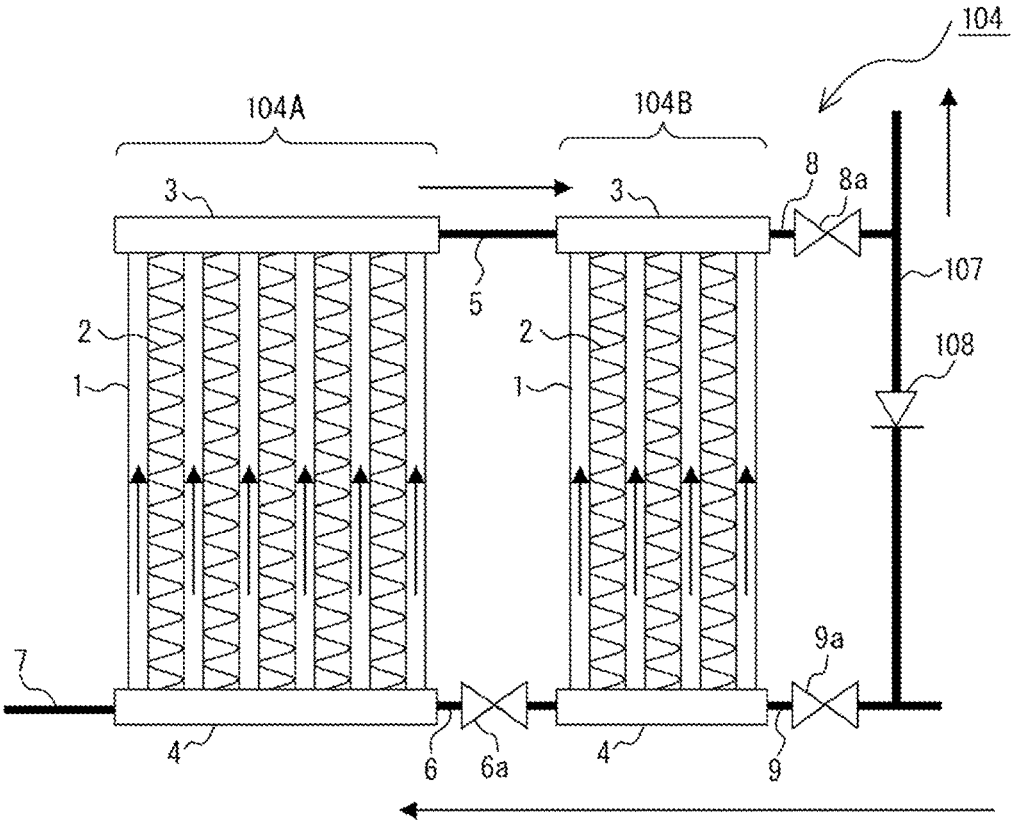
FIG. 6 is an explanatory diagram that illustrates operation of the heat exchanger according to the present Embodiment 1 during heating operation.

To solve this problem, in the outdoor heat exchanger 104 according to the present Embodiment 1, the opening-closing valve 6*a* is controlled in response to the operational frequency of the compressor 101 set in advance, in the manner as illustrated in FIGS. 4 to 6 to change the flow direction of refrigerant flowing through the first heat exchange unit 104A and the second heat exchange unit 1046. Note that the arrows illustrated in FIGS. 4 to 6 represent the flow direction of refrigerant. Every opening-closing valve in an opened state is represented by a white valve symbol. Every opening-closing valve in a closed state is represented by a black valve symbol.

First, FIG. 4 is an explanatory diagram that illustrates operation of the heat exchanger according to the present Embodiment 1 when the air-conditioning load is low during cooling operation. As illustrated in FIG. 4, the outdoor heat exchanger 104 has a configuration in which when the air-conditioning load is low during cooling operation, the opening-closing valve 6*a* of the second connection pipe 6 is brought into a closed state, such that refrigerant in the first heat exchange unit 104A flows in the upward direction, while refrigerant in the second heat exchange unit 104B flows in the downward direction.

Gas refrigerant flowing into the lower header 4 of the first heat exchange unit 104A from the first flow pipe 7 is distributed to the flat tubes 1 of the first heat exchange unit 104A. At this time, the opening-closing valve 6*a* of the second connection pipe 6 is in a closed state. This prevents the gas refrigerant having flowed into the lower header 4 of the first heat exchange unit 104A from flowing into the lower header 4 of the second heat exchange unit 1046. The gas refrigerant flows upward inside the flat tubes 1 to condense and liquefy into liquid refrigerant. The liquid refrigerant in the flat tubes 1 joins together in the upper header 3, and flows through the first connection pipe 5 into the upper header 3 of the second heat exchange unit 1046. The liquid refrigerant flowing into the upper header 3 of the second heat exchange unit 1046 is distributed to the flat tubes 1 of the second heat exchange unit 104B, and flows downward inside the flat tubes 1. This allows the liquid refrigerant to be subcooled. At this time, the opening-closing valve 8*a* of the second flow pipe 8 is in a closed state. This prevents the liquid refrigerant having flowed into the upper header 3 of the second heat exchange unit 1046 from flowing out to the refrigerant pipe 107 through the second flow pipe 8. The liquid refrigerant, flowing downward inside the flat tubes 1 of the second heat exchange unit 1046, joins together in the lower header 4, then flows out to the refrigerant pipe 107 through the third flow pipe 9 with the opening-closing valve 9*a* brought into an opened state, and thereafter flows to the expansion mechanism 103.

As described above, the part-load operation with a reduced operational frequency of the compressor 101 is performed when the air-conditioning load is low during cooling operation. In this part-load operation, only refrigerant in the first heat exchange unit 104A is allowed to flow upward inside the flat tubes 1, the refrigerant flow velocity required for refrigerant to flow upward inside the flat tubes 1 is thus obtained, and consequently degradation in the heat exchange performance is reduced.

FIG. 5 is an explanatory diagram that illustrates operation of the heat exchanger according to the present Embodiment 1 when the air-conditioning load is high during cooling operation. As illustrated in FIG. 5, the outdoor heat exchanger 104 has a configuration in which when the air-conditioning load is high during cooling operation, the opening-closing valve 6*a* of the second connection pipe 6 is brought into an opened state, such that refrigerant in both the first heat exchange unit 104A and the second heat exchange unit 104B flows in the upward direction.

Gas refrigerant flowing into the lower header 4 of the first heat exchange unit 104A from the first flow pipe 7 is distributed to the flat tubes 1 of the first heat exchange unit 104A, while flowing into the lower header 4 of the second heat exchange unit 104B through the second connection pipe 6. At this time, the opening-closing valve 9*a* of the third flow pipe 9 is in a closed state. This prevents the gas refrigerant having flowed into the lower header 4 of the second heat exchange unit 1046 from flowing out to the refrigerant pipe 107 through the third flow pipe 9. The gas refrigerant flows upward inside the flat tubes 1 of both the first heat exchange unit 104A and the second heat exchange unit 104B to condense and liquefy into liquid refrigerant. The liquid refrigerant in the flat tubes 1 joins together in each upper header 3. The liquid refrigerant in the upper header 3 of the first heat exchange unit 104A flows into the upper header 3 of the second heat exchange unit 1046 through the first connection pipe 5, and then joins with the liquid refrigerant in the upper header 3 of the second heat exchange unit 1046. The liquid refrigerant having joined together flows out to the refrigerant pipe 107 through the second flow pipe 8 with the opening-closing valve 8*a* brought into an opened state, then passes through the valve body 108, and flows to the expansion mechanism 103.

There is a case where the air-conditioning load is so high during cooling operation that it is unnecessary to reduce the operational frequency of the compressor 101. In this case, the heat exchange efficiency is increased by allowing refrigerant in both the first heat exchange unit 104A and the second heat exchange unit 104B to flow in the upward direction as described above.

FIG. 6 is an explanatory diagram that illustrates operation of the heat exchanger according to the present Embodiment 1 during heating operation. As illustrated in FIG. 6, the outdoor heat exchanger 104 has a configuration in which the opening-closing valve 6*a* of the second connection pipe 6 is brought into an opened state during heating operation, such that refrigerant in both the first heat exchange unit 104A and the second heat exchange unit 1046 flows in the upward direction.

Two-phase gas-liquid refrigerant flows into the lower header 4 of the second heat exchange unit 104B from the third flow pipe 9 with the opening-closing valve 9*a* brought into an opened state. This two-phase gas-liquid refrigerant is distributed to the flat tubes 1 of the second heat exchange unit 1046, while flowing into the lower header 4 of the first heat exchange unit 104A through the second connection pipe 6. At this time, the flow direction of the second flow switching means 106 is controlled such that the two-phase gas-liquid refrigerant having flowed into the lower header 4 of the first heat exchange unit 104A is prevented from flowing out to the first flow pipe 7. The two-phase gas-liquid refrigerant flows upward inside the flat tubes 1 of both the first heat exchange unit 104A and the second heat exchange unit 1046 to evaporate and vaporize into gas refrigerant. The gas refrigerant in the flat tubes 1 joins together in each upper header 3. The gas refrigerant in the upper header 3 of the first heat exchange unit 104A flows into the upper header 3 of the second heat exchange unit 1046 through the first connection pipe 5, and then joins with the gas refrigerant in the upper header 3 of the second heat exchange unit 1046. The gas refrigerant having joined together flows out to the refrigerant pipe 107 through the second flow pipe 8 with the opening-closing valve 8*a* brought into an opened state, and then flows to the compressor 101. Note that the pressure in the third flow pipe 9 is higher than the pressure in the second flow pipe 8 during heating operation, the gas refrigerant flowing out of the second flow pipe 8 is thus prevented from flowing toward the valve body 108.

There is a case where the air-conditioning load is so high during heating operation that it is unnecessary to reduce the operational frequency of the compressor. In this case, the heat exchange efficiency is increased by allowing refrigerant in both the first heat exchange unit 104A and the second heat exchange unit 104B to flow in the upward direction as described above.

Embodiment 2

Figure 7:
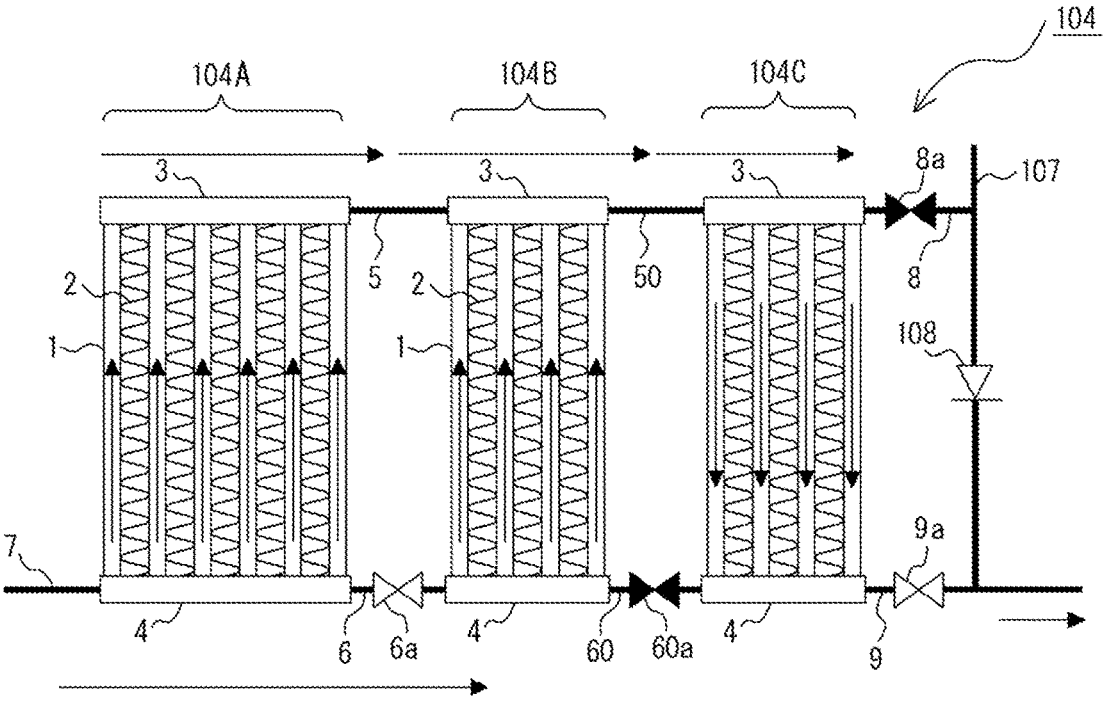
FIG. 7 is an explanatory diagram that illustrates operation of a heat exchanger according to the present Embodiment 2 when the air-conditioning load is low during cooling operation.
Figure 8:
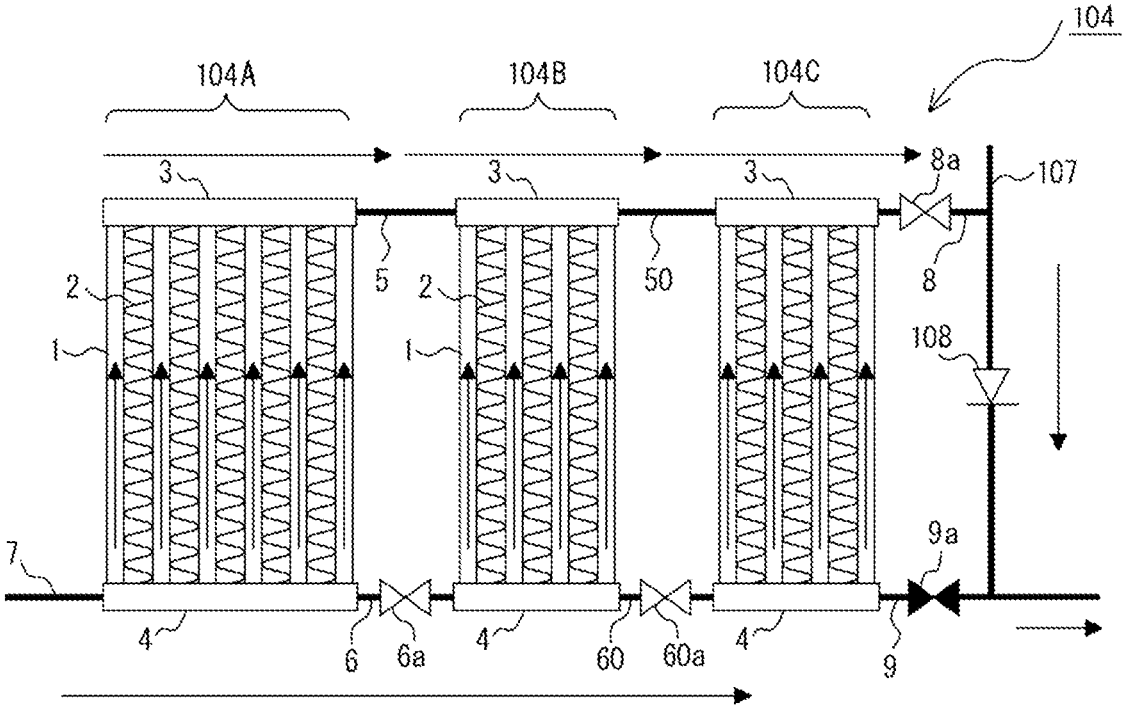
FIG. 8 is an explanatory diagram that illustrates operation of the heat exchanger according to the present Embodiment 2 when the air-conditioning load is high during cooling operation.
Figure 9:
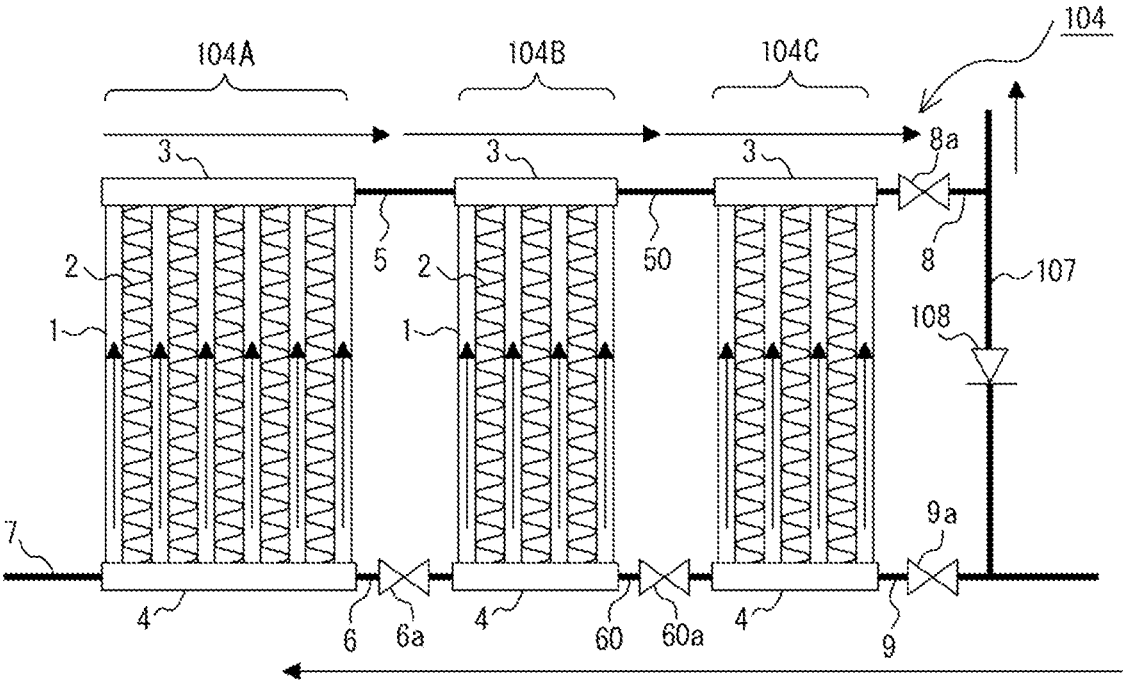
FIG. 9 is an explanatory diagram that illustrates operation of the heat exchanger according to the present Embodiment 2 during heating operation.

Next, the heat exchanger 104 according to the present Embodiment 2 and the air-conditioning apparatus 300 including this heat exchanger 104 are described on the basis of FIGS. 7 to 9 with reference to FIGS. 1 and 2. FIG. 7 is an explanatory diagram that illustrates operation of the heat exchanger according to the present Embodiment 2 when the air-conditioning load is low during cooling operation. FIG. 8 is an explanatory diagram that illustrates operation of the heat exchanger according to the present Embodiment 2 when the air-conditioning load is high during cooling operation. FIG. 9 is an explanatory diagram that illustrates operation of the heat exchanger according to the present Embodiment 2 during heating operation. Note that the constituent elements that are the same as those of the heat exchanger 104 described in Embodiment 1, and the constituent elements that are the same as those of the air-conditioning apparatus 300 including this heat exchanger 104 are denoted by the same reference signs, and descriptions of such constituent elements are appropriately omitted.

As illustrated in FIGS. 7 to 9, the outdoor heat exchanger 104 according to the present Embodiment 2 includes the first heat exchange unit 104A, the second heat exchange unit 1048, and a third heat exchange unit 104C, each of which exchanges heat between refrigerant and air. As illustrated in FIG. 2, each of the first heat exchange unit 104A, the second heat exchange unit 1048, and the third heat exchange unit 104C includes a plurality of flat tubes 1 spaced from and parallel to each other and in which refrigerant flow passages 10 are formed through which refrigerant flows in an up-down direction Y, a plurality of fins 2 provided between the flat tubes 1 adjacent to each other, an upper header 3 to which respective upper end portions of the plurality of flat tubes 1 are connected, and a lower header 4 to which respective lower end portions of the plurality of flat tubes 1 are connected.

As illustrated in FIG. 7, the first heat exchange unit 104A, the second heat exchange unit 104B, and the third heat exchange unit 104C are located next to each other. One end of the upper header 3 of the first heat exchange unit 104A is connected to one end of the upper header 3 of the second heat exchange unit 1048 by the first connection pipe 5 such that these upper headers 3 communicate with each other. The other end of the upper header 3 of the second heat exchange unit 104B is connected to one end of the upper header 3 of the third heat exchange unit 104C by a third connection pipe 50 such that these upper headers 3 communicate with each other.

One end of the lower header 4 of the first heat exchange unit 104A is connected to one end of the lower header 4 of the second heat exchange unit 104B by the second connection pipe 6 such that these lower headers 4 communicate with each other. The second connection pipe 6 is provided with the opening-closing valve 6*a*, which is controlled by the controller 109. The opening-closing valve 6*a* is, for example, a solenoid valve. The other end of the lower header 4 of the second heat exchange unit 104B is connected to one end of the lower header 4 of the third heat exchange unit 104C by a fourth connection pipe 60 such that these lower headers 4 communicate with each other. The fourth connection pipe 60 is provided with an opening-closing valve 60*a*, which is controlled by the controller 109. The opening-closing valve 60*a* is, for example, a solenoid valve.

Note that instead of connecting the upper header 3 of the first heat exchange unit 104A, the upper header 3 of the second heat exchange unit 1046, and the upper header 3 of the third heat exchange unit 104C to each other by the first connection pipe 5 and the third connection pipe 50, these upper headers 3 may be made up of a single upper header, although the single upper header is not illustrated. In addition, instead of connecting the lower header 4 of the first heat exchange unit 104A, the lower header 4 of the second heat exchange unit 1046, and the lower header 4 of the third heat exchange unit 104C to each other by the second connection pipe 6 and the fourth connection pipe 60, these lower headers 4 may be made up of a single lower header. In this case, inside the single lower header, an opening-closing valve is provided to control communication between the first heat exchange unit 104A and the second heat exchange unit 1046, and an opening-closing valve is also provided to control communication between the second heat exchange unit 104B and the third heat exchange unit 104C.

The other end of the lower header 4 of the first heat exchange unit 104A is connected to the first flow pipe 7. The first flow pipe 7 branches off from a portion of the refrigerant pipe 107 connected between the first flow switching means 102 and the outdoor heat exchanger 104. The other end of the upper header 3 of the third heat exchange unit 104C is connected through the second flow pipe 8 to a portion of the refrigerant pipe 107 connected between the second flow switching means 106 and the expansion mechanism 103. The second flow pipe 8 is provided with the opening-closing valve 8*a*, which is controlled by the controller 109. The opening-closing valve 8*a* is, for example, a solenoid valve.

The other end of the lower header 4 of the third heat exchange unit 104C is connected through the third flow pipe 9 to a portion of the refrigerant pipe 107 connected between the expansion mechanism 103 and the connection point with the second flow pipe 8. The third flow pipe 9 is provided with the opening-closing valve 9*a*, which is controlled by the controller 109. The opening-closing valve 9*a* is, for example, a solenoid valve.

In the outdoor heat exchanger 104 according to the present Embodiment 2, the opening-closing valves 6*a* and 60*a* are controlled in response to the operational frequency of the compressor 101 set in advance, in the manner as illustrated in FIGS. 7 to 9 to change the flow direction of refrigerant flowing through the first heat exchange unit 104A, the second heat exchange unit 1046, and the third heat exchange unit 104C. Note that the arrows illustrated in FIGS. 7 to 9 represent the flow direction of refrigerant. Every opening-closing valve in an opened state is represented by a white valve symbol. Every opening-closing valve in a closed state is represented by a black valve symbol.

As illustrated in FIG. 7, in the outdoor heat exchanger 104, when the air-conditioning load is low during cooling operation, first the opening-closing valve 6*a* of the second connection pipe 6 is brought into an opened state, while the opening-closing valve 60*a* of the fourth connection pipe 60 is brought into a closed state. That is, refrigerant in both the first heat exchange unit 104A and the second heat exchange unit 104B flows in the upward direction, while refrigerant in the third heat exchange unit 104C only flows in the downward direction.

Gas refrigerant flowing into the lower header 4 of the first heat exchange unit 104A from the first flow pipe 7 is distributed to the flat tubes 1 of the first heat exchange unit 104A. Simultaneously, the gas refrigerant flows into the lower header 4 of the second heat exchange unit 1046 through the second connection pipe 6, and is then distributed to the flat tubes 1 of the second heat exchange unit 1046. At this time, the opening-closing valve 60*a* of the fourth connection pipe 60 is in a closed state. This prevents the gas refrigerant having flowed into the lower header 4 of the second heat exchange unit 1046 from flowing into the lower header 4 of the third heat exchange unit 104C. The gas refrigerant flows upward inside the flat tubes 1 to condense and liquefy into liquid refrigerant. The liquid refrigerant in the flat tubes 1 joins together in each upper header 3. The liquid refrigerant in the upper header 3 of the first heat exchange unit 104A flows into the upper header 3 of the second heat exchange unit 104B through the first connection pipe 5, and then joins with the liquid refrigerant in the upper header 3 of the second heat exchange unit 104B. The liquid refrigerant having joined together flows into the upper header 3 of the third heat exchange unit 104C through the third connection pipe 50. The liquid refrigerant flowing into the upper header 3 of the third heat exchange unit 104C is distributed to the flat tubes 1 of the third heat exchange unit 104C, and flows downward inside the flat tubes 1. This allows the liquid refrigerant to be subcooled. At this time, the opening-closing valve 8*a* of the second flow pipe 8 is in a closed state. This prevents the liquid refrigerant having flowed into the upper header 3 of the third heat exchange unit 104C from flowing out to the refrigerant pipe 107 through the second flow pipe 8. The liquid refrigerant, flowing downward inside the flat tubes 1 of the third heat exchange unit 104C, joins together in the lower header 4, then flows out to the refrigerant pipe 107 through the third flow pipe 9 with the opening-closing valve 9*a* brought into an opened state, and thereafter flows to the expansion mechanism 103.

As described above, the part-load operation with a reduced operational frequency of the compressor 101 is performed when the air-conditioning load is low during cooling operation. In this part-load operation, only refrigerant in the first heat exchange unit 104A and the second heat exchange unit 1046 is allowed to flow upward inside the flat tubes 1, the refrigerant flow velocity required for refrigerant to flow upward inside the flat tubes 1 is thus obtained, and consequently degradation in the heat exchange performance is reduced.

Note that the outdoor heat exchanger 104 may have a configuration in which the opening-closing valve 6*a* of the second connection pipe 6 is brought into a closed state, and the opening-closing valve 60*a* of the fourth connection pipe 60 is brought into a closed state to allow only refrigerant in the first heat exchange unit 104A to flow upward inside the flat tubes 1, although this configuration is not illustrated.

As illustrated in FIG. 8, the outdoor heat exchanger 104 has a configuration in which when the air-conditioning load is high during cooling operation, the opening-closing valve 6*a* of the second connection pipe 6 is brought into an opened state, and the opening-closing valve 60*a* of the fourth connection pipe 60 is brought into an opened state, such that refrigerant in the first heat exchange unit 104A, the second heat exchange unit 104B, and the third heat exchange unit 104C all flows in the upward direction.

Gas refrigerant flowing into the lower header 4 of the first heat exchange unit 104A from the first flow pipe 7 is distributed to the flat tubes 1 of the first heat exchange unit 104A. Simultaneously, this gas refrigerant flows into the lower header 4 of the second heat exchange unit 1046 through the second connection pipe 6, and further flows into the lower header 4 of the third heat exchange unit 104C through the fourth connection pipe 60. At this time, the opening-closing valve 9*a* of the third flow pipe 9 is in a closed state. This prevents the gas refrigerant having flowed into the lower header 4 of the third heat exchange unit 104C from flowing out to the refrigerant pipe 107 through the third flow pipe 9. The gas refrigerant flows upward inside the flat tubes 1 of all the first heat exchange unit 104A, the second heat exchange unit 104B, and the third heat exchange unit 104C to condense and liquefy into liquid refrigerant. The liquid refrigerant in the flat tubes 1 joins together in each upper header 3. The liquid refrigerant in the upper header 3 of the first heat exchange unit 104A flows into the upper header 3 of the second heat exchange unit 1046 through the first connection pipe 5, and then joins with the liquid refrigerant in the upper header 3 of the second heat exchange unit 1046. The liquid refrigerant having joined together flows into the upper header 3 of the third heat exchange unit 104C through the third connection pipe 50, and then joins with the liquid refrigerant in the upper header 3 of the third heat exchange unit 104C. This liquid refrigerant having joined together flows out to the refrigerant pipe 107 through the second flow pipe 8 with the opening-closing valve 8*a* brought into an opened state, then passes through the valve body 108, and flows to the expansion mechanism 103.

There is a case where the air-conditioning load is so high during cooling operation that it is unnecessary to reduce the operational frequency of the compressor 101. In this case, the heat exchange efficiency is increased by allowing refrigerant in the first heat exchange unit 104A, the second heat exchange unit 104B, and the third heat exchange unit 104C to all flow in the upward direction as described above.

As illustrated in FIG. 9, the outdoor heat exchanger 104 has a configuration in which during heating operation, the opening-closing valve 6*a* of the second connection pipe 6 is brought into an opened state, and the opening-closing valve 60*a* of the fourth connection pipe 60 is brought into an opened state, such that refrigerant in the first heat exchange unit 104A, the second heat exchange unit 104B, and the third heat exchange unit 104C all flows in the upward direction.

Two-phase gas-liquid refrigerant flowing into the lower header 4 of the third heat exchange unit 104C from the third flow pipe 9 is distributed to the flat tubes 1 of the third heat exchange unit 104C. Simultaneously, this two-phase gas-liquid refrigerant flows into the lower header 4 of the second heat exchange unit 1046 through the fourth connection pipe 60, and further flows into the lower header 4 of the first heat exchange unit 104A through the second connection pipe 6. At this time, the flow direction of the second flow switching means 106 is controlled such that the two-phase gas-liquid refrigerant having flowed into the lower header 4 of the first heat exchange unit 104A is prevented from flowing out to the first flow pipe 7. The two-phase gas-liquid refrigerant flows upward inside the flat tubes 1 of all the first heat exchange unit 104A, the second heat exchange unit 1046, and the third heat exchange unit 104C to evaporate and vaporize into gas refrigerant. The gas refrigerant in the flat tubes 1 joins together in each upper header 3. The gas refrigerant in the upper header 3 of the first heat exchange unit 104A flows into the upper header 3 of the second heat exchange unit 104B through the first connection pipe 5, and then joins with the gas refrigerant in the upper header 3 of the second heat exchange unit 1046. This gas refrigerant having joined together flows into the upper header 3 of the third heat exchange unit 104C through the third connection pipe 50, and then joins with the gas refrigerant in the upper header 3 of the third heat exchange unit 104C. This gas refrigerant having joined together flows out to the refrigerant pipe 107 through the second flow pipe 8 with the opening-closing valve 8*a* brought into an opened state, and then flows to the compressor 101. Note that the pressure in the third flow pipe 9 is higher than the pressure in the second flow pipe 8 during heating operation, the gas refrigerant flowing out of the second flow pipe 8 is thus prevented from flowing toward the valve body 108.

There is a case where the air-conditioning load is so high during heating operation that it is unnecessary to reduce the operational frequency of the compressor 101. In this case, the heat exchange efficiency is increased by allowing refrigerant in the first heat exchange unit 104A, the second heat exchange unit 104B, and the third heat exchange unit 104C to all flow in the upward direction as described above.

The heat exchanger 104, and the air-conditioning apparatus 300 including this heat exchanger 104 have been described above on the basis of the embodiments. However, the heat exchanger 104 and the air-conditioning apparatus 300 are not limited to the configurations described in the above embodiments. For example, the heat exchanger 104 is made up of two or three heat exchange units in the above embodiments, but may be made up of four or more heat exchange units. In addition, for example, the heat exchanger 104 and the air-conditioning apparatus 300 are not limited to the ones made up of the constituent elements described above, but may include other constituent element. To sum up, the heat exchanger 104 and the air-conditioning apparatus 300 include a range of design changes and application variations usually made by a person skilled in the art without departing from the technical spirit of the heat exchanger 104 and the air-conditioning apparatus 300.

The invention claimed is:

1. A heat exchanger comprising a plurality of heat exchange units configured to exchange heat between refrigerant and air, each of the plurality of heat exchange units including a plurality of flat tubes spaced from and parallel to each other and in which a refrigerant flow passage is formed through which refrigerant flows in an up-down direction, a plurality of fins provided between the plurality of flat tubes adjacent to each other, an upper header to which respective upper end portions of the plurality of flat tubes are connected, and a lower header to which respective lower end portions of the plurality of flat tubes are connected, in the plurality of heat exchange units, the upper headers being connected such that the upper headers communicate with each other, the lower headers being connected such that the lower headers communicate with each other through an opening-closing valve, wherein the heat exchanger includes a configuration in which when the heat exchanger serves as an evaporator, the opening-closing valve is controlled such that refrigerant in all the plurality of heat exchange units flows in an upward direction, the heat exchanger having a configuration in which when the heat exchanger serves as a condenser, the opening-closing valve is controlled such that:

refrigerant in at least one of the plurality of heat exchange units flows in the upward direction, and refrigerant in an other one or other ones of the plurality of heat exchange units flows in a downward direction, and the refrigerant enters the heat exchanger at the lower header, and then flows, in this order, in the upward direction in the at least one of the plurality of heat exchange units, through the upper header, in the downward direction through the other one or other ones of the plurality of heat exchange units, and then exits the heat exchanger.

2. The heat exchanger of claim 1, wherein the heat exchanger includes the configuration in which when the heat exchanger serves as the condenser, the opening-closing valve is controlled such that refrigerant in all the plurality of heat exchange units flows in the upward direction.

3. An air-conditioning apparatus comprising:

a compressor; and the heat exchanger of claim 1, through which refrigerant discharged from the compressor flows, wherein the opening-closing valve is controlled in response to an operational frequency of the compressor set in advance.

4. The air-conditioning apparatus of claim 3, further comprising:

a controller configured to:

control the opening-closing valve in response to the operational frequency of the compressor set in advance, when the heat exchanger serves as the evaporator, control the opening-closing valve to the configuration in which refrigerant in all the plurality of heat exchange units flows in the upward direction, and when the heat exchanger serves as the condenser, control the opening-closing valve to the configuration the configuration in which refrigerant in the at least one of the plurality of heat exchange units flows in the upward direction, and refrigerant in the other one or other ones of the plurality of heat exchange units flows in the downward direction.

5. The heat exchanger of claim 1, further comprising:

a controller configured to:

when the heat exchanger serves as the evaporator, control the opening-closing valve to the configuration in which refrigerant in all the plurality of heat exchange units flows in the upward direction, when the heat exchanger serves as the condenser, control the opening-closing valve to the configuration the configuration in which refrigerant in the at least one of the plurality of heat exchange units flows in the upward direction, and refrigerant in the other one or other ones of the plurality of heat exchange units flows in the downward direction.

* * * * *